United States Patent [19]

Lingaraju

[11] 4,389,082

[45] Jun. 21, 1983

[54] STRAIN RELIEF CLAMP

[75] Inventor: Bhartoor Lingaraju, Allentown, Pa.

[73] Assignee: Square D Company, Palatine, Ill.

[21] Appl. No.: 199,770

[22] Filed: Oct. 23, 1980

[51] Int. Cl.[3] ..... H01R 13/58

[52] U.S. Cl. ..... 339/103 R

[58] Field of Search ..... 339/103 R, 103 C, 103 M, 339/105, 107

[56] References Cited

U.S. PATENT DOCUMENTS

| | | | |
|---|---|---|---|
| 3,390,371 | 6/1968 | Kramer | 339/107 |
| 3,701,505 | 10/1972 | Klumpp | 339/103 C X |
| 3,856,376 | 12/1974 | Poliak et al. | 339/107 |

*Primary Examiner*—Eugene F. Desmond

*Attorney, Agent, or Firm*—John R. Garrett; Donald P. Reynolds; Stephen A. Litchfield

[57] ABSTRACT

This disclosure depicts a novel frictional locking non-rotatable strain relief clamp for securing an electrical conductor which is attached to an electrical plug or socket and for relieving strain on the attachment of the conductor and plug or socket. The strain relief clamp comprises a first clamp section having front and back walls and a curved side wall. The back wall has a radially extending narrow slot centered in the first clamp section. A second clamp section also has front and back walls and a curved side wall. The back wall has a radially extending narrow slot centered in the second clamp section. A means for holding the first clamp section to the second clamp section is provided such that the back wall of the first clamp section aligns with the back wall of the second clamp section. The strain relief clamp further comprises a unitary adapter having two retaining means for slideably engaging the slots in the first and second clamp sections. The two retaining means are diametrically opposed on the unitary adapter. The unitary adapter also has an aperture for receiving the electrical conductor and means for fastening the adapter to the electrical plug or socket.

5 Claims, 7 Drawing Figures

STRAIN RELIEF CLAMP

BACKGROUND OF THE INVENTION AND PRIOR ART STATEMENT

The present invention relates in general to strain relief clamps for securing electrical conductors and in particular to an improved frictional locking non-rotatable strain relief clamp for use with an electrical plug or socket. Typically, the wire ends of the electrical conductor are attached to the plug or socket assembly by means of screws. It is important to prevent the conductor from being pulled loose from the screws when a tension is applied to the conductor. Numerous types of strain relief clamps of varying complexity are found in the prior art to achieve this purpose.

U.S. Pat. No. 3,390,371 discloses a strain relief clamp for use with an electrical plug or socket. The strain relief clamp is best shown in FIG. 8 and comprises a support bracket and two cable clamps and is described in column 5, lines 55–75, and column 6, lines 1–60 of the specification. The two cable clamps slide onto the support bracket and are held in place by two screws which pass through openings in one cable clamp into threaded holes in the other cable clamp. The support bracket is attached to the plug or socket by a pair of screws. The clamp members comprise a hollow semi-circular shell with the addition of a wall and two grooves on one side of the hollow shell. The grooves align with flanges on the support bracket and hold the clamp sections in position.

The present invention is a novel improvement on the strain relief clamp as depicted in U.S. Pat. No. 3,390,371. In that patent the cable clamps disclosed require a large amount of nonmetallic material and are somewhat complex in structure. Also the disclosed strain relief clamp utilizes a metallic support bracket which is expensive. Because of the type of structure used, even if the metallic support bracket were designed using nonmetallic material, the support bracket would require a substantial amount of material.

U.S. Pat. No. 3,390,371 is the closest prior art of which applicant is aware, but applicant does not represent that a search has been made or that no better art exists. A concise explanation of the relevance of the patent has been given above and a copy of the patent is being submitted with this specification.

The relevance of the prior art indicated in the present specification should be not be given a limited interpretation. The prior art item may be found to have relevance in a passage other than the one referred to or to have relevance in a sense different than as stated.

OBJECTS OF THE INVENTION

It is a general object of the present invention to provide an improved strain relief clamp for electrical plug or socket.

It is a more specific object of the present invention to provide an inexpensive yet structurally strong strain relief clamp.

It is a further object of the present invention to provide a strain relief clamp which is non-rotatable and provides frictional locking for the electrical conductor.

It is a further object of the present invention to provide a strain relief clamp which is simple to manufacture and low in cost.

DESCRIPTION OF THE PREFERRED EMBODIMENT

This invention pertains to a novel strain relief clamp for securing an electrical conductor which is attached to an electrical plug or socket. More specifically the strain relief clamp relieves the strain on the attachment of the conductor and plug or socket when a tension is applied to the conductor. The strain relief clamp insures that the electrical conductor is not pulled loose from the plug or socket.

The present invention will now be described. The present invention is an improved frictional locking non-rotatable strain relief clamp for securing an electrical conductor which is attached to an electrical plug or socket and for relieving strain on the attachment of the conductor and plug or socket. The strain relief clamp comprises a first clamp section having front and back walls and a curved side wall. The back wall has a radially extending narrow slot centered in the first clamp section. A second clamp section also has front and back walls and a curved side wall. The back wall has a radially extending narrow slot centered in the second clamp section. A means for holding the first clamp section to the second clamp section is provided such that the back wall of the first clamp section aligns with the back wall of the second clamp section. The strain relief clamp further comprises a unitary adapter having two retaining means for slideably engaging the slots in the first and second clamp sections. The two retaining means are diametrically opposed on the unitary adapter. The unitary adapter also has an aperture for receiving the electrical conductor and means for fastening the adapter to the electrical plug or socket.

The electrical conductor is first inserted through the aperture in the unitary adapter and then the first clamp section is placed on the unitary adapter with the slot in the back wall of the first clamp section being engaged by one of the retaining means on the unitary adapter. The second clamp section is placed on the unitary adapter with the slot in the back wall of the second clamp section engaging the other retaining means on the unitary adapter. The two clamp sections are moved towards one another until the electrical conductor is clamped securely between them and the two clamp sections are held in place by the securing means.

Figure 1:
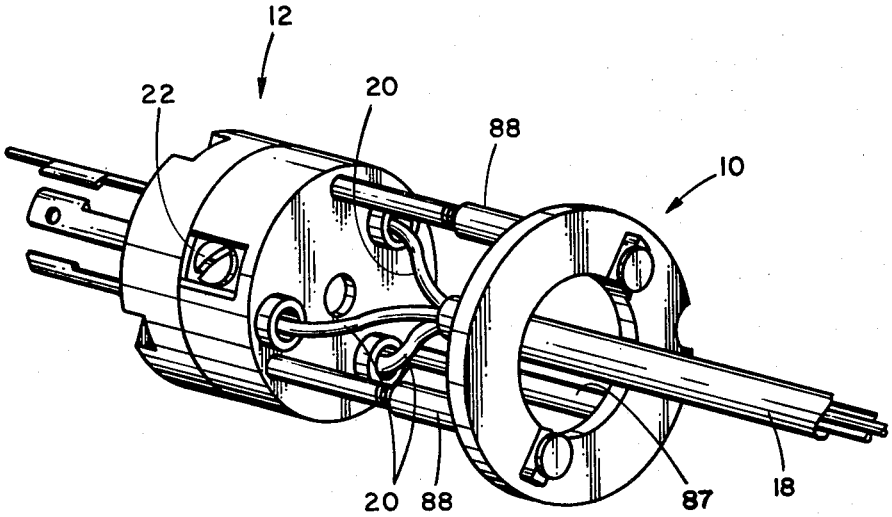
FIG. 1 is a perspective view of the novel strain relief clamp attached to an electrical plug.
Figure 2:
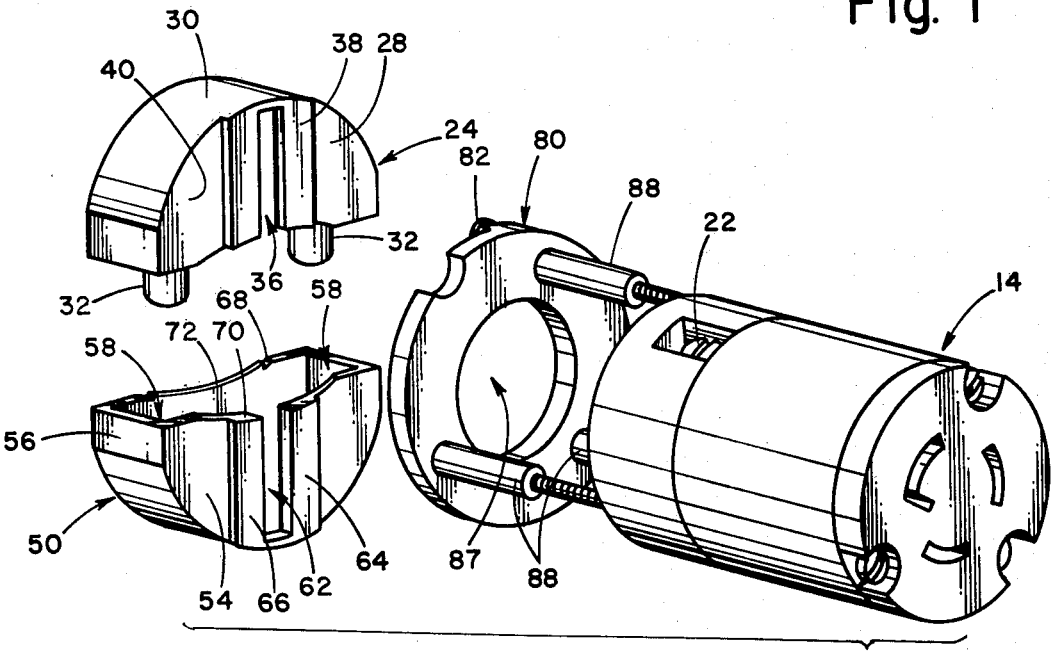
FIG. 2 is a partially exploded perspective view of the novel strain relief clamp attached to an electrical socket.
Figure 3:
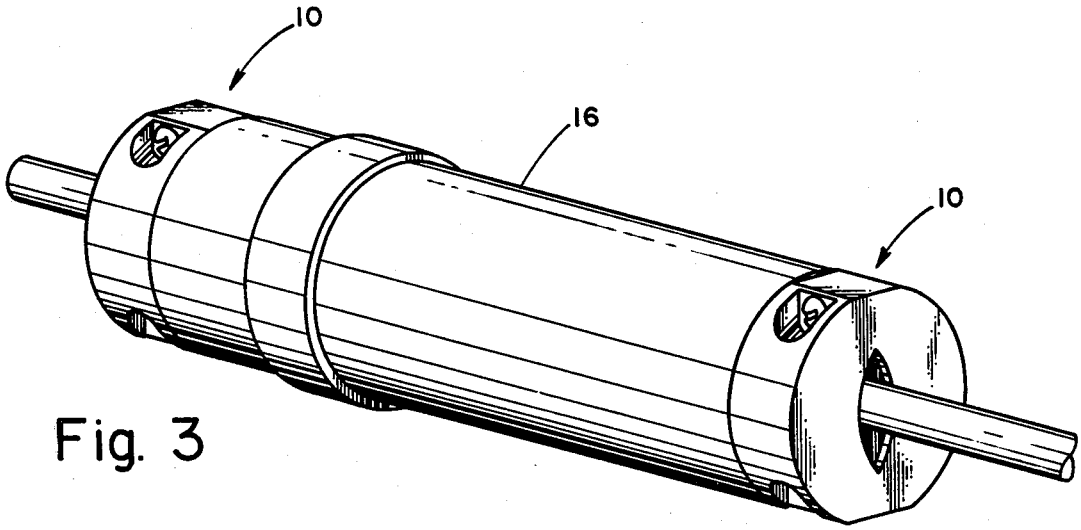
FIG. 3 is a perspective view of an assembled electrical plug and socket utilizing the novel strain relief cable clamp.

A preferred embodiment of the present invention is illustrated in FIGS. 1, 2 & 3. A strain relief clamp 10 is shown attached to an electrical plug 12 in FIG. 1 and to an electrical socket 14 in FIG. 2. FIG. 3 shows the complete assembly wherein a two-piece flexible rubber-like jacket 16 covers the entire plug and socket assemblies. The flexible jacket 16 prevents dirt, dust and other foreign particles from entering the plug and socket once they are attached together. FIG. 1 shows the plug assembly having an electrical conductor 18 attached to the plug 12. FIG. 2 shows the strain relief clamp in an exploded view with the clamp being attached to the socket 14. In both FIGS. 1 & 2, the flexible jacket 16 has been omitted so that the details of the attachment of the strain relief clamp 10 to the plug 12 and socket 14 can be seen. Typically the electrical conductor 18 has three wires 20 which are held in place on the plug 12 or socket 14 by screws 22.

Figure 4:
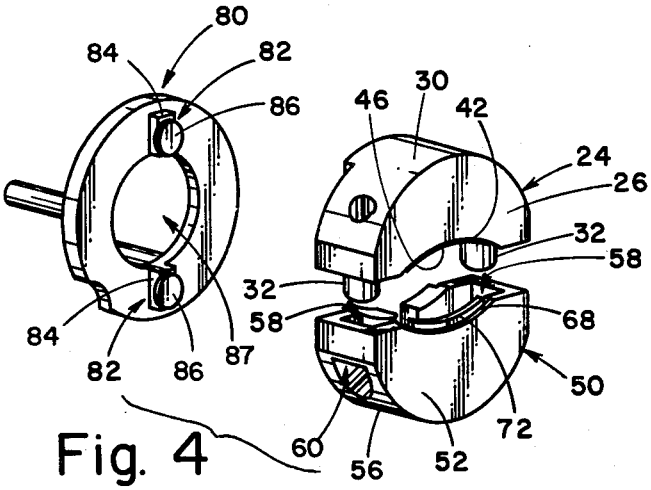
FIG. 4 is a perspective exploded view of the novel clamp.
Figure 6:
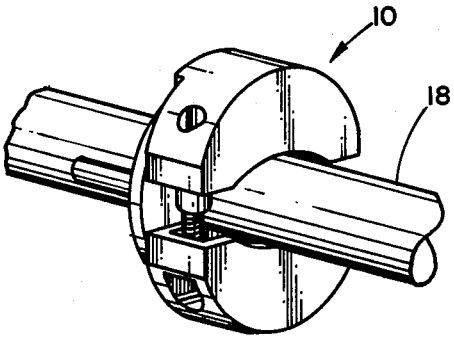
FIG. 6 is a perspective view of the strain relief clamp with a conductor in place and securely clamped.
Figure 5:
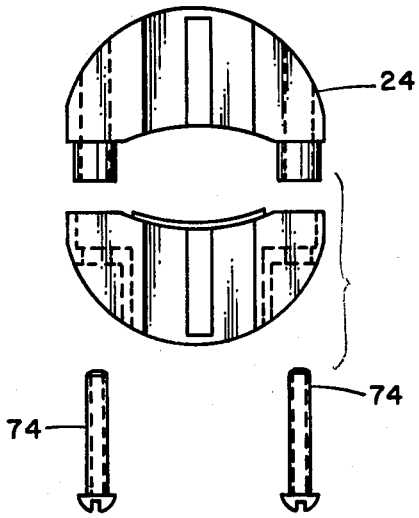
FIG. 5 is an end view of two clamp sections and two retaining screws of the strain relief clamp.

FIG. 4 is an exploded perspective view of the strain relief clamp 10 from the opposite view as shown in FIG. 2. FIG. 5 is an end view of a portion of the strain relief clamp and FIG. 6 shows the strain relief clamp securing an electrical conductor. As shown in FIGS. 2, 4, & 5 the strain relief clamp comprises a first generally semi-circular clamp section 24 having front and back walls 26 and 28 and a curved side wall 30. The first clamp section 24 also has a fastening post 32 on each end of the first clamp section 24. Each of the fastening posts 32 has a threaded aperture 34. The back wall 28 has a narrow radially extending slot 36 centered in the first semi-circular clamp section 24. First and second strengthening walls 38 and 40 are positioned on either side of the narrow radially extending slot 36 for preventing breakage of the back wall 28. Both of the front and back walls 26 and 28 have generally elliptical notches 42 and 44. The notch 42 in the front wall 26 has an engaging ridge 46 for securing the electrical conductor 18.

A second generally semi-circular clamp section 50 has front and back walls 52 and 54 and a curved side wall 56. The second clamp section 50 has a recess 58 in each end of the second clamp section 50 for receiving the post 32 of the first clamp section 24. A hole 60 is provided in each end of the second clamp section 50 which aligns with the threaded apertures 34 in the first clamp section 24 when the first and second clamp sections 24 and 50 are assembled. Similarily to the first clamp section 24, the second clamp section 50 has a radially extending narrow slot 62 centered in the second semi-circular clamp section 50 with first and second strengthening walls 64 and 66 positioned on either side of the narrow radially extending slot 62 for preventing breakage of the back wall 54. The front and back walls 52 and 54 have generally elliptical notches 68 and 70. The notch 68 in the front wall 52 has an engaging ridge 72 for securing the conductor 18. The engaging ridges 46 and 72 in cooperation with the notches 42, 44, 68 and 70 prevent the electrical conductor 18 from slipping in the strain relief clamp.

A pair of screws 74 are received by the holes 60 in the second clamp section 50 and are threaded into the threaded apertures 34 in the fastening posts 32 of the first clamp section 24 for holding the first and second clamp sections together.

A ring-shaped unitary adapter 80 has two retaining T-shaped posts 82 for slideably engaging the slots 36 and 62 in the first and second clamp sections 24 and 50. The two retaining T-shaped posts 82 are diametrically opposed on the unitary adapter 80. The T-shaped posts 82 comprise a substantially rectangular support block 84 with a center located aperture and a metal rivet 86 extending through the aperture in the rectangular support block 84 and through an aperture 87 in the ring shaped unitary adapter 80. The head of the rivet 86 is wider than the support block 82 and is located on the opposite side of the support block 84 from the ring shaped unitary adapter 80. The unitary adapter 80 also has an aperture 87 for receiving the electrical conductor 18. The unitary adapter 80 also has means 88 for fastening the adapter 80 to the electrical plug 12 or the electrical socket 14. In the preferred embodiment the means 88 comprises three elongated legs each having a threaded aperture for receiving three long screws. Numerous other methods of attaching the unitary adapter to the electrical plug or socket can be envisioned.

The electrical conductor 18 is first inserted through the aperture 87 in the unitary adapter 80 and then the first clamp section 24 is placed on the unitary adapter 80 with the slot 36 in the back wall 28 of the first clamp section 24 being engaged by one of the retaining posts 82 on the unitary adapter 80. The second clamp section 50 is placed on the unitary adapter with the slot 62 in the back wall 54 of the second clamp section 50 engaging the other retaining post 82 on the unitary adapter 80. The two clamp sections are moved toward one another until the electrical conductor 18 is clamped securely between them in the notches 42, 44, 68 and 70 of the first and second clamp sections 24 and 50. The two clamp sections 24 and 50 are held in place by the pair of screws 74. FIG. 6 shows the strain relief clamp 10 securely holding an electrical conductor 18.

The two strengthening walls 38 and 40 on the first clamp section 24 are each wider than the width of the corresponding top edge of the T-shaped posts 82 on the ring shaped adapter. The width of the strengthening walls is not critical and may vary but the presence of the strengthening walls ensures that the back walls 28 and 54 will not break when the strain relief clamp is assembled on a conductor and a tension is applied to the conductor.

Figure 7:
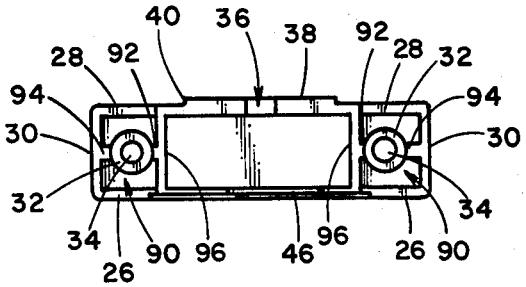
FIG. 7 is a bottom view of one of the clamp sections of the strain relief clamp.

As shown in FIG. 7 each of the fastening posts 32 in the first clamp section 24 is retained in a substantially square opening 90 in the first clamp section 24 by two web members 92 and 94 which are diametrically opposed on the post 32. The substantially square opening 90 is defined by the end of the curved side wall 30, portions of the front and back walls 26 and 28, and an interior wall 96. This structure provides a strong post for holding the two clamp sections together yet uses a minimum amount of material and therefore reduces the cost of the clamp section.

The strain relief clamp of the present invention may be made in a variety of sizes depending on the plug and socket sizes. In the preferred embodiment the clamp sections are typically about four times as wide as they are thick. A wall thickness of approximately 3/16" or about $4\frac{3}{4}$ millimeters is typical. The strengthening walls have a thickness of approximately $\frac{1}{4}$" or about $6\frac{1}{3}$ millimeters. The dimensions however can be changed substantially with the requirements of the use of the strain relief clamp without departing from the inventive concepts disclosed. The first and second clamp sections and the unitary adapter can be readily injection molded from various nonmetallic materials. In the preferred embodiment the strain relief clamp is molded using a polycarbonate material, sold under the trademark LEXAN.

The invention is not limited to the particular details of the device depicted and other modifications and applications are contemplated. Certain other changes may be made in the above described device without departing from the true spirit and scope of the invention herein involved. It is intended therefore that the subject matter in the above depiction shall be interpreted as illustrative and not in a limiting sense.

The invention is claimed as follows:

1. An improved frictional locking non-rotatable strain-relief clamp for securing an electrical conductor which is attached to an electrical plug or socket and for relieving strain on the attachment of the conductor and plug or socket, said strain relief clamp comprising:

a first generally semi-circular clamp section having front and back walls and a curved side wall, said first clamp section also having a fastening post on each end of said first clamp section, each of said posts having a threaded aperture, said back wall having a narrow radially extending slot centered in said first semi-circular clamp section, first and second strengthening walls positioned on either side of said narrow radially extending slot for preventing breakage of said back wall, each of said front and back walls having a generally elliptical notch, said notch in said front wall having an engaging ridge for securing the conductor;

a second generally semi-circular clamp section having front and back walls and a curved side wall, said second clamp section also having a recess in each end of said second clamp section for receiving said posts of said first clamp section and a hole in each end of said second clamp section aligning with said threaded apertures in said first clamp section when said first and second clamp sections are assembled, said back wall having a radially extending narrow slot centered in said second semi-circular clamp section with first and second strengthening walls positioned on either side of said narrow radially extending slot for preventing breakage of said back wall, said front and back walls having a generally elliptical notch, said notch in said front wall having an engaging ridge for securing the conductor;

a pair of screws to be received by said holes in said second clamp section and to be threaded into said threaded apertures in said fastening posts of said first clamp section;

a ring shaped unitary adapter having two retaining T-shaped posts for slideably engaging said slots in said first and second clamp sections, said two retaining T-shaped posts being diametrically opposed on said unitary adapter, said T-shaped posts comprising substantially a rectangular support block with a center located aperture and a metal rivet extending through said aperture in said rectangular support block and through an aperture in said ring shaped unitary adapter, said head of said rivet being wider than said support block and being located on the opposite side of said support block from said ring shaped adapter, said unitary adapter also having an aperture for receiving the electrical conductor and means for fastening said adapter to an electrical plug or socket;

wherein the electrical conductor is first inserted through the aperture in said unitary adapter and then said first clamp section is placed on said unitary adapter with said slot in said back wall of said first clamp section being engaged by one of said retaining posts on said unitary adapter, said second clamp section is placed on said unitary adapter with said slot in said back wall of said second clamp section engaging said other retaining post on said unitary adapter, whereby said two clamp sections are moved towards one another until the electrical conductor is clamped securely between them in the notches of said first and second clamp sections and said two clamp sections are held in place by said pair of screws.

2. The device as defined in claim 1 wherein said two strengthening walls are each wider than the width of the corresponding top edge of said T-shaped post on said ring shaped adaptor.

3. The device as defined in claim 1 wherein each of said fastening posts in said first clamp section are retained in a substantially square opening in said first clamp section by two web members diametrically opposed on said post, said substantially square opening being defined by the end of said curved side wall, a portion of said front and back walls, and an interior wall.

4. An improved frictional locking nonrotatable strain-relief clamp for securing an electrical conductor which is attached to an electrical plug or socket and for relieving strain on the attachment of the conductor and plug or socket, said relief clamp comprising:

a first generally semicircular clamp section having front and back walls and a curved side wall, said first clamp section also having a fastening post on each end of said first clamp section, each of said posts having a threaded aperture, each of said fastening posts in said first clamp section being retained in a substantially square opening in said first clamp section by two web members diametrically opposed on said post, said substantially square opening being defined by the end of said curved side wall, a portion of said front and back walls, and an interior wall, said back wall having a narrow radially extending slot centered in said first semicircular clamp section, each of said front and back walls having a notch;

a second generally semicircular clamp section having front and back walls and a curved side wall, said second clamp section also having a recess in each end of said second clamp section for receiving said posts of said first clamp section and a hole in each end of said second clamp section aligning with said threaded apertures in said first clamp section when said first and second clamp sections are assembled, said back wall having a radially extending narrow slot centered in said second semicircular clamp section, said front and back walls having a notch;

a pair of screws to be received by said holes in said second clamp section and to be threaded into said threaded apertures in said fastening posts of said first clamp section;

a ring shaped unitary adapter having two retaining T-shaped posts for slideably engaging said slots in said first and second clamp sections, said two retaining T-shaped posts being diametrically opposed on said unitary adapter, said unitary adapter also having an aperture for receiving the electrical conductor and means for fastening said adapter to an electrical plug or socket;

wherein the electrical conductor is first inserted through the aperture in said unitary adapter and then said first clamp section is placed on said unitary adapter with said slot in said back wall of said first clamp section being engaged by one of said retaining means on the unitary adapter, said second clamp section is placed on said unitary adapter with said slot in said back wall of said second clamp section engaging said other retaining posts on said unitary adapter, whereby said two clamp sections are moved towards one another until the electrical conductor is clamped securely between them in the notches of said first and second clamp sections and said two clamp sections are held in place by said pair of screws.

5. An improved frictional locking nonrotatable strain-relief clamp for securing an electrical conductor which is attached to an electrical plug or socket and for relieving strain on the attachment of the conductor and plug or socket, said relief clamp comprising:

a first generally semicircular clamp section having front and back walls and a curved side wall, said first clamp section also having a fastening post on each end of said first clamp section, each of said posts having a threaded aperture, said back wall having a narrow radially extending slot centered in said first semicircular clamp section, each of said front and back walls having a notch;

a second generally semicircular clamp section having front and back walls and a curved side wall, said second clamp section also having a recess in each end of said second clamp section for receiving said posts of said first clamp section and a hole in each end of said second clamp section aligning with said threaded apertures in said first clamp section when said first and second clamps sections are assembled, said back wall having a radially extending narrow slot centered in said second semicircular clamp section, said front and back walls having a notch;

a pair of screws to be received by said holes in said second clamp section and to be threaded into said threaded apertures in said fastening posts of said first clamp section;

a ring shaped unitary adapter having two retaining T-shaped posts for slideably engaging said slots in said first and second clamp sections, said two retaining T-shaped posts being diametrically opposed on said unitary adapter, said two retaining T-shaped posts forming a substantially rectangular support block with a center located aperture and a metal rivet extending through said aperture in said rectangular support block and through an aperture in said ring-shaped unitary adapter, said head of said rivet being wider than said support block and located on the opposite side of said support block from said ring-shaped adapter, said unitary adapter also having an aperture for receiving the electrical conductor and means for fastening said adapter to an electrical plug or socket;

wherein the electrical conductor is first inserted through the aperture in said unitary adapter and then said first clamp section is placed on said unitary adapter with said slot in said back wall of said first clamp section being engaged by one of said retaining means on the unitary adapter, said second clamp section is placed on said unitary adapter with said slot in said back wall of said second clamp section engaging said other retaining posts on said unitary adapter, whereby said two clamp sections are moved towards one another until the electrical conductor is clamped securely between them in the notches of said first and second clamp sections and said two clamp sections are held in place by said pair of screws.

* * * * *